US007089616B2

(12) United States Patent
Funatogawa

(10) Patent No.: US 7,089,616 B2
(45) **Date of Patent: *Aug. 15, 2006**

(54) COMPOSITE PILLOW

(75) Inventor: Hiroyuki Funatogawa, Ashikaga (JP)

(73) Assignee: Kabushiki Kaisha Dokuta Eru, Ashikaga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/136,603

(22) Filed: May 25, 2005

(65) Prior Publication Data

US 2005/0262637 A1 Dec. 1, 2005

(30) Foreign Application Priority Data

May 28, 2004 (JP) ..... 2004-159206

(51) Int. Cl.
*A47G 9/00* (2006.01)

(52) U.S. Cl. ..... 5/636

(58) Field of Classification Search ..... 5/636, 5/640, 643, 637, 645, 727; D6/601
See application file for complete search history.

(56) References Cited

U.S. PATENT DOCUMENTS

| | | | | |
|---|---|---|---|---|
| 3,243,828 | A * | 4/1966 | McCarty | 5/636 |
| 3,521,310 | A * | 7/1970 | Greenawalt | 5/636 |
| 3,924,283 | A * | 12/1975 | Shave | 5/636 |
| 4,803,743 | A * | 2/1989 | Greenawalt | 5/636 |
| 4,916,765 | A * | 4/1990 | Castronovo, Jr. | 5/640 |
| 5,533,218 | A * | 7/1996 | Fahy | 5/636 |
| 5,638,564 | A * | 6/1997 | Greenawalt et al. | 5/636 |
| 5,682,633 | A * | 11/1997 | Davis | 5/636 |
| 6,817,049 | B1 * | 11/2004 | Hall | 5/636 |
| 6,978,502 | B1 * | 12/2005 | Calagui | 5/640 |
| 2005/0217029 | A1 * | 10/2005 | Funatogawa | 5/645 |

FOREIGN PATENT DOCUMENTS

| | | |
|---|---|---|
| JP | 11-056562 | 3/1999 |
| JP | 2003-144286 | 5/2003 |
| JP | 2003-180499 | 7/2003 |

* cited by examiner

*Primary Examiner*—Alexander Grosz
(74) *Attorney, Agent, or Firm*—Bacon & Thomas, PLLC

(57) ABSTRACT

A composite pillow which prevents difference in level and a depression from being formed at a contact surface between divided core material parts, thereby prevents discomfort to a user. The composite pillow has core parts of different material or different hardness located at proper positions. The composite pillow is divided into a central part and a holding part for holding the central part by face-to-face contact and the parts are arranged in parallel. The central part and the holding part differ in hardness or material; and right and left contact surfaces of the holding parts contacting the central part and corresponding contact surfaces of the central part are diagonally formed.

16 Claims, 8 Drawing Sheets

(A)

(B)

(C)

COMPOSITE PILLOW

CROSS REFERENCE TO RELATED APPLICATIONS

Applicant's copending applications U.S. Ser. No. 11/076,037 and U.S. Ser. No. 11/136,603 are directed to related subject matter.

BACKGROUND OF THE INVENTION

1. Field of the Invention

The present invention relates to a composite pillow configured by combining a plurality of (more properly, three or more) divided parts, and mainly to a composite pillow for improving the fit and functions of a pillow by providing a different hardness or material for each part.

2. Description of the Related Art

In order to improve the fit or other functions of a pillow, different materials or hardnesses are required in different sections of the pillow. Examples of an integrally formed pillow include those made of a urethane-based resin, of a natural material such as a rubber-based material, and of a liquid material, gel material or gaseous material, filled into a pillow case having a structure which can maintain the shape thereof. In such a pillow, it is extremely difficult to locate parts of different materials or hardnesses at proper positions.

In order to locate parts of different materials or hardnesses at proper positions, there has been provided a composite pillow in which a pillow core material is divided into a plurality of parts arranged as parallel sections. A pillow has also been provided, as shown in Japanese Unexamined Patent Publication No. 2003-180499, in which a plurality of compartments are formed within a pillow case, each filled with a core material.

In the case where the pillow in which divided parts of a core material are vertically stacked, as shown in Japanese Unexamined Patent Publication No. Hei 11-056562, the areas of distribution for different materials or hardnesses cannot be set accurately, thereby being not much different from an integrally formed pillow. Pillows having divided parts of a core material horizontally arranged are shown in Japanese Unexamined Patent Publication No. 2003-144286 and pillows having a plurality of compartments arranged in parallel and filled with a core material are shown in Japanese Unexamined Patent Publication No. 2003-180499, both types of which can be set up accurately. However, since the contact surfaces between adjacent divided parts of core material are almost perpendicular, there are drawbacks in creating discomfort due to difference in levels, resulting from different hardness between the parts, and such that a depression is formed in the divided core material when used.

SUMMARY OF THE INVENTION

The present invention has been made to eliminate the above-mentioned drawbacks and to achieve the following objects.

It is a first object of the present invention to configure a pillow for preventing a difference in levels and a depression from being formed where parts of the divided core material contact, thereby preventing discomfort to a user.

It is a second object of the present invention to configure a pillow for locating core parts of different materials or core parts of different hardnesses at proper positions.

In order to achieve the above-mentioned objects, a first aspect of the present invention is a composite pillow divided into a central part and holding parts for holding the central part at parallel contact surfaces, wherein the central part and the holding parts differ in hardness or material, and wherein right and left contact surfaces between the holding parts and the central part are diagonally formed. The first aspect includes not only a composite pillow in which the holding parts are arranged in parallel on the right and left sides of the central part, but also a composite pillow in which the holding parts are arranged in parallel on the upper and lower sides of the central part.

A second aspect of the present invention is a composite pillow divided into a central part and right and left holding parts for holding the central part by contact at parallel contact surfaces, wherein the central part and the holding parts differ in hardness or material, wherein the contact surfaces of the right and left holding parts contacting the central part are inclined inward into a lower portion of the central part, and wherein the corresponding contact surfaces of the central part are inclined so as to cover the contact surfaces of the holding parts. Specifically, the second aspect is a composite pillow in which the holding parts are arranged in parallel on the right and left sides of the central part.

A third aspect of the present invention is an improvement of the composite pillow according to the second aspect, adding the following features to the composite pillow according to the second aspect. The central part is divided into a neck side part and a head top side part in face-to-face contact with the neck side part; both parts differ in hardness or material; and the contact surfaces of the neck side part and the head top side part arranged parallel are diagonally formed.

In accordance with the first aspect of the invention, in which the composite pillow is divided into the central part and the holding parts for holding the central part, which parts are arranged in parallel along their contact surfaces, the right and left contact surfaces of the holding parts contacting the central part and the corresponding contact surfaces of the central part are diagonally formed. Accordingly, since one of the adjacent parts overlaps the other, there is no difference in level, even when the parts differ in hardness or material, thereby providing a composite pillow whose joints are imperceptible to a user.

Also, since the central part and the holding parts differ in hardness or material, the overlap between the central part and the holding part can bring a sense in use of the composite pillow which a single core material cannot achieve, and can provide different functions by employing parts different in hardness or material.

In accordance with the second aspect of the invention, the holding parts are located on the right and left sides of the central part; the contact surfaces of the right and left holding parts contacting the central part are inclined so as to protrude toward the lower portion of the central part; and the corresponding contact surfaces of the central part are inclined so as to cover the contact surfaces of the holding parts. Accordingly, the contact surface of the central part diagonally overlaps the contact surface of the holding part, thereby providing a composite pillow which is level and has joints imperceptible to a user.

Furthermore, the central part presses down against the contact surfaces of the holding parts located below, due to the load of a head applied onto the center of the composite pillow. In this manner the central part and the holding parts are tightly fixed to each other, thereby eliminating the possibility of sliding apart from each other.

In accordance with the third aspect of the invention, the central part is divided into a neck side portion and a head top side portion contacting the neck side portion with face-to-face contact, wherein both portions differ in hardness or material, and wherein the contact surfaces of the neck side portion and the head top side portion are parallel and diagonally formed. This enables the composite pillow to be easily manufactured and to protect the neck and cervical vertebrae, while difference in level between the neck side portion and the head top side portion is imperceptible.

DESCRIPTION OF THE PREFERRED EMBODIMENTS

Figure 1:
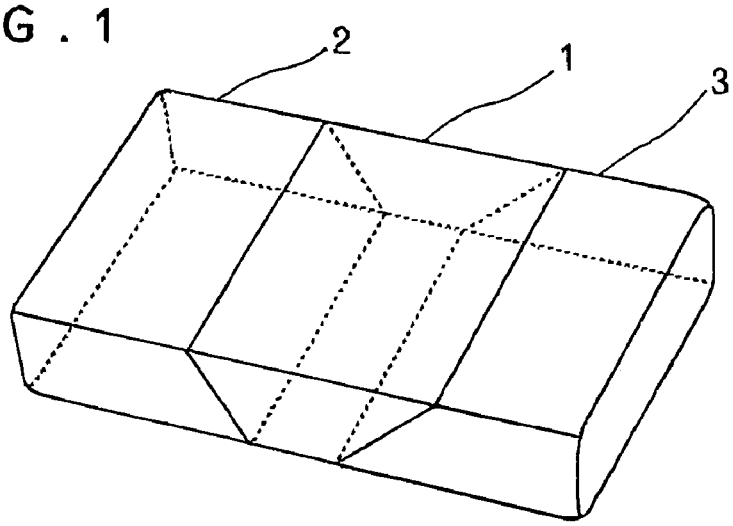
FIG. 1 is a perspective view showing a composite pillow according to a first embodiment.
Figure 2:
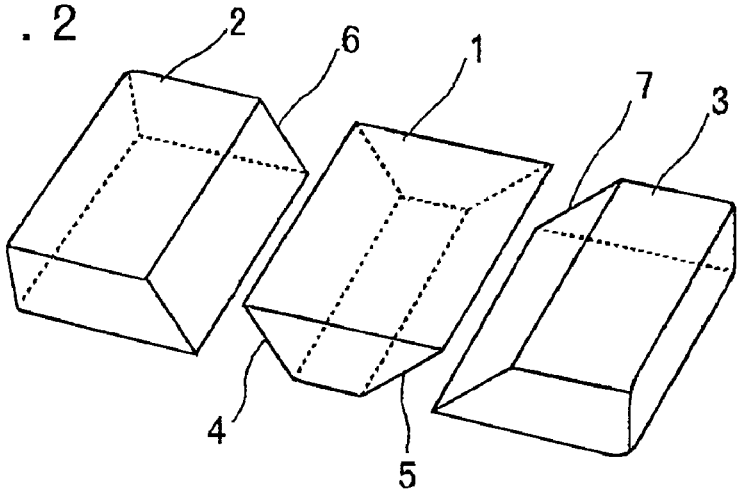
FIG. 2 is an exploded perspective view showing the composite pillow according to the first embodiment.
Figure 3:
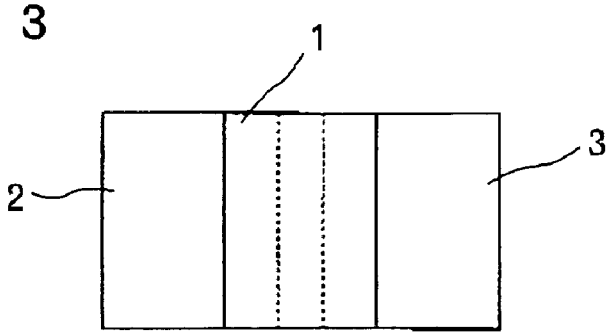
FIG. 3 is a plan view of the composite pillow according to the first embodiment.
Figure 4:
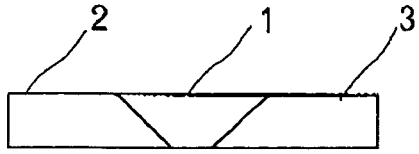
FIG. 4 is a front view of the composite pillow according to the first embodiment.
Figure 5:
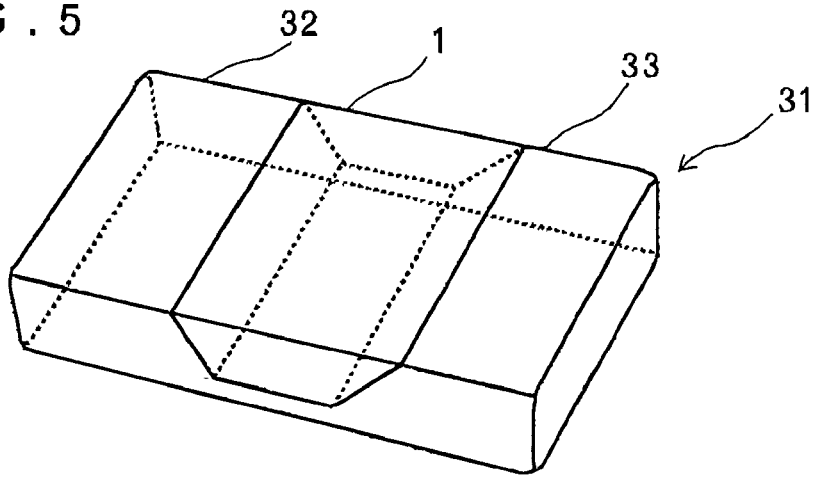
FIG. 5 is a perspective view showing right and left holding parts in an integral type composite pillow.
Figure 6:
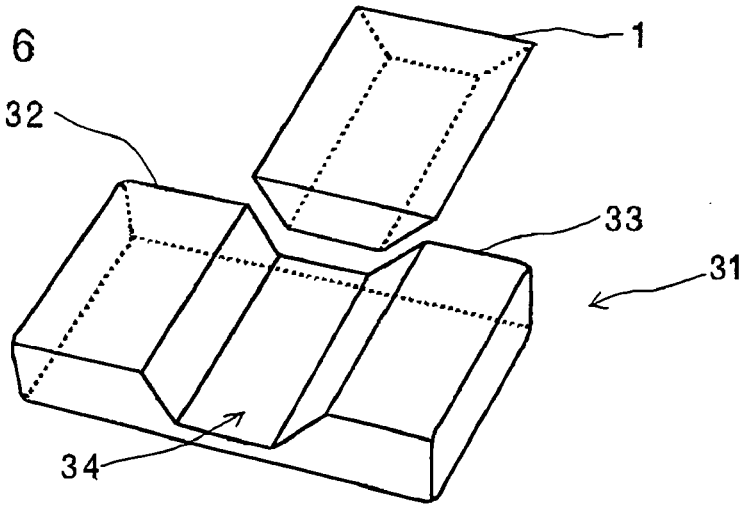
FIG. 6 is an exploded perspective view of the integral type composite pillow of FIG. 5.
Figure 7:
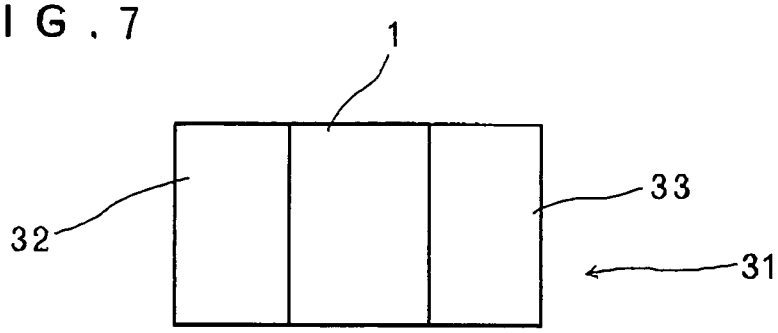
FIG. 7 is a plan view of the integral type composite pillow of FIG. 5.
Figure 8:
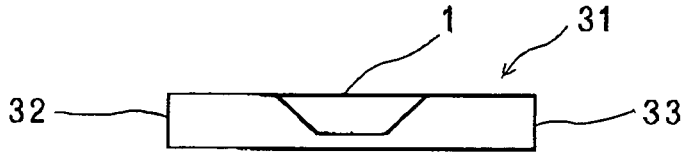
FIG. 8 is a front view of the integral type composite pillow of FIG. 5.

The composite pillow according to the first embodiment, as shown in FIGS. 1–4, is divided into a central part 1, and a left holding part 2 and a right holding part 3 for holding the central part 1 by a face-to-face contact.

The central part 1 and the right and left holding parts 2, 3 are different in hardness or material. In this embodiment, urethanes of different hardnesses are employed. The hardnesses are expressed by the sinking into the pillow due to the weight of a human head. A soft urethane whose sinking ratio is 60% is employed for the central part 1 and a hard urethane whose sinking ratio is 20% is employed for the right and left holding parts 2, 3, thereby providing different hardnesses. This is just one example of a hardness combination, and other combinations are possible as a matter of course.

A urethane or polyethylene resin material, or a rubber-based natural material is suitable when the same material of different hardnesses is employed as in this embodiment.

While an integrally formed member is employed as each of the central part 1 and the right and left holding parts 2, 3 in this embodiment, the parts may be formed by filling a material into a case having the shape of each part 1, 2, 3, such as feathers, resin chips, wood chips such as Japanese cypress, cushioning material, buckwheat chaff, and tea leaves.

The contact surfaces 4, 5, 6, 7 of the central part 1 and the right and left holding parts 2, 3 are diagonally formed. Specifically, the contact surfaces 6, 7 of the right and left holding parts contacting the central part 1 are inclined outwardly toward the lower portion of the central part 1, and the corresponding contact surfaces 4, 5 of the central part 1 are inclined so as to cover the contact surfaces 6, 7 of the right and left holding parts 2, 3. If the central part 1 is made of a material capable of changing shape to conform to the shape of the contact surfaces 6, 7 inclined so as to intrude into the lower portion of the central part 1, since the shape of the contact surfaces 4, 5 of the central part 1 is regulated by the contact surfaces 6, 7 of the right and left holding parts 2, 3 the contact surfaces 4, 5 need not be provided with a fixed inclined, definite shape beforehand.

Figure 9:
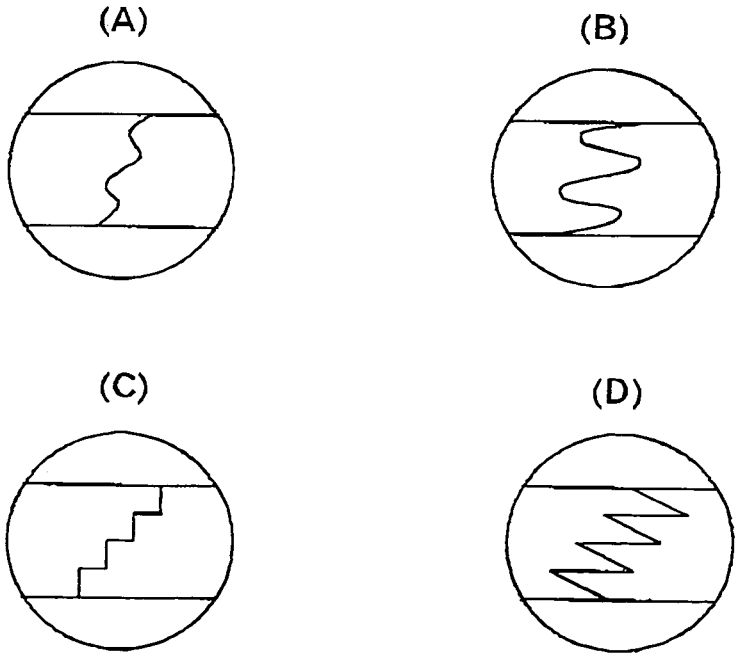
FIGS. 9A and 9B show contact surfaces of a curved waveform.
FIGS. 9C and 9D show contact surfaces of a zigzag waveform.

While the contact surfaces 4, 5, 6, 7 are smooth planar surfaces in this embodiment, the contact surfaces 4, 5, 6, 7 may be curved and wavy as shown in FIGS. 9A and 9B or may be zigzag as shown in FIGS. 9C and 9D.

The central part 1 and the right and left holding parts 2, 3 are arranged in parallel so that the contact surface 6 of the left holding part 2 is in contact with the contact surface 4 of the central part 1, and that the contact surface 7 of the right holding part 3 is in contact with the contact surface 5 of the central part 1. The central part 1 and the right and left holding parts 2, 3 are normally adhered to each other by an adhesive or the like. As a matter of course, when each part is put into a pillow case with an interior which is partitioned or the like, or when the contact surfaces, 4, 6 and the contact surfaces 5, 7 are to be fitted to each other, a non-adhesive state is sometimes acceptable. While the first embodiment is illustrated as having the holding parts 2, 3 separated from each other for convenience of explanation, they may be formed into an integral type holding part 31 with a recess portion 34 for holding the central part 1 at the center, as shown in FIGS. 5 to 8.

Figure 10:
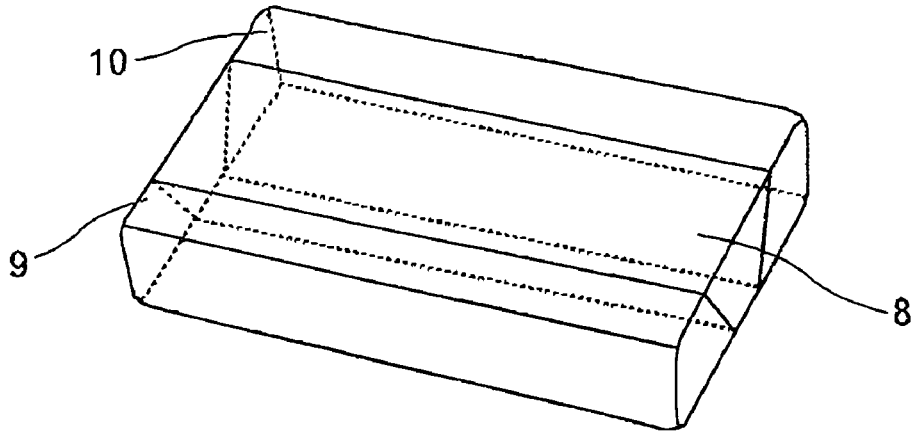
FIG. 10 is a perspective view showing a composite pillow according to a second embodiment.
Figure 11:
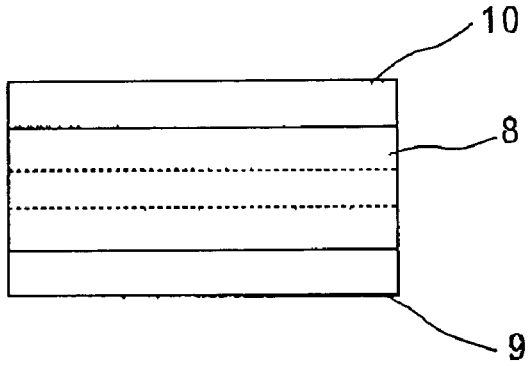
FIG. 11 is a plan view of the composite pillow according to the second embodiment.
Figure 12:
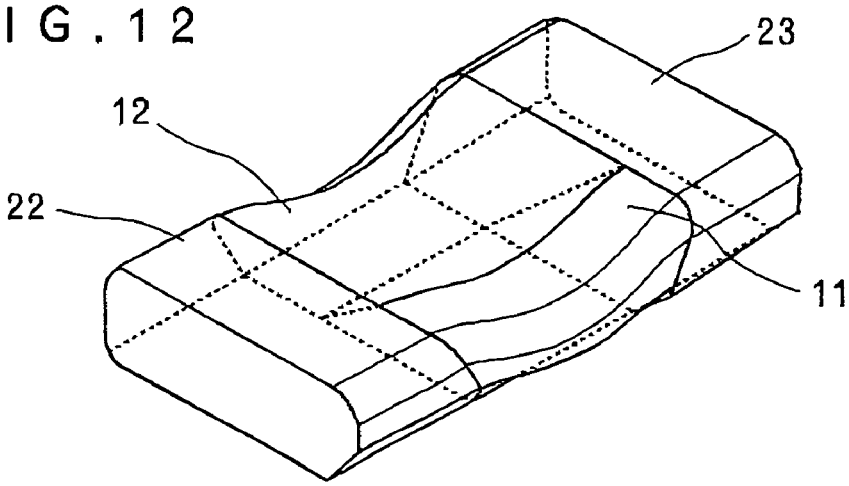
FIG. 12 is a perspective view showing a composite pillow according to a third embodiment.
Figure 13:
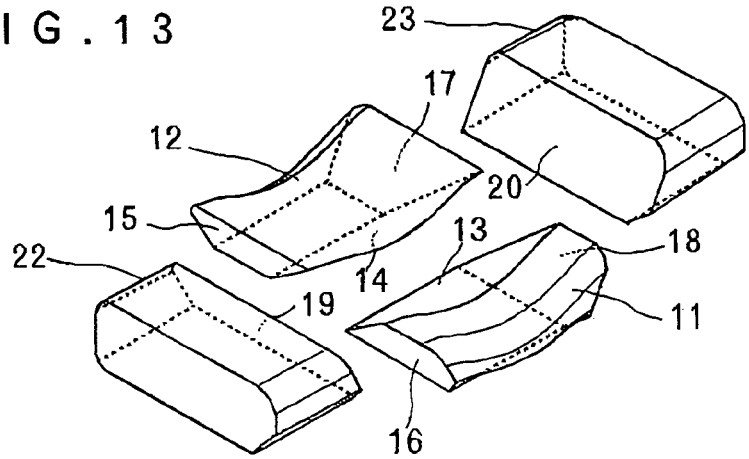
FIG. 13 is an exploded perspective view showing the composite pillow according to the third embodiment.
Figure 14:
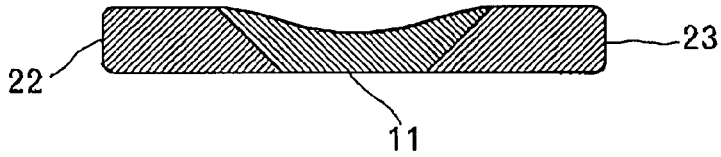
FIG. 14 is a transverse sectional view showing a section of right and left holding parts and a neck side portion of a central part.
Figure 15:
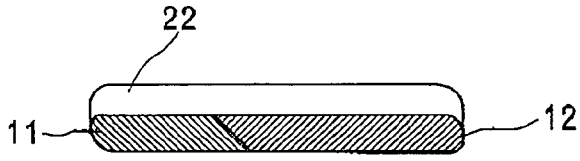
FIG. 15 is a longitudinal sectional view showing a section of a neck side portion of a central part and a head top side portion of the central part.

As shown in FIGS. 10 and 11, the composite pillow according to the second embodiment is divided into an elongated central part 8, a neck side holding part 9 for holding the elongated central part 8 by a face-to-face contact and a head top side holding part 10. While the holding parts 2, 3 of the first embodiment are arranged so as to hold the central part 1 from the right and left sides, in the second embodiment the elongated central part 8 is held from the neck side and the head top side when used (from the upper and lower sides in FIG. 10 and FIG. 11).

The material of the central part 8 and the neck side and head top side holding parts 9, 10 in the second embodiment, similarly to the first embodiment, are urethanes of different hardnesses. Describing the hardnesses expressed in terms of the sinking by the weight of a human head when using the composite pillow, a soft urethane whose sinking ratio is 60% is employed for the central part 1 and a rather hard urethane whose sinking ratio is 40% is employed for the neck side and head top side holding parts 9, 10, thereby achieving different hardnesses. This is just one example of a hardness combination, and other settings are possible as a matter of course.

The contact surfaces of the elongated central part 8 and the neck side and head top side holding parts 9, 10 are also diagonally formed. Specifically, the contact surfaces of the neck side and head top side holding parts, 9, 10, contacting the central part 8, are inclined so as to protrude toward the lower portion of the central part 8, and the corresponding contact surfaces of the central part 8 are inclined so as to cover the contact surfaces of the holding parts 9, 10. In addition, the shape and contact condition of the contact surface and the like of the second embodiment are similar to those of the first embodiment.

As shown in FIGS. 12–15, in the composite pillow according to the third embodiment, each edge of the pillow is rounded; the central part 1 of the first embodiment is broken down into a neck side central portion 11 and a head top side central portion 12; the neck side and head top side central portions 11, 12 are formed curved downward at the center, from right to left; and planar contact surfaces are arranged in parallel at contact with a left holding part 22 and a right holding part 23.

The materials of the neck side and head top side central portions 11, 12 and the right and left holding parts 22, 23, similarly to the first embodiment and the second embodiment, areurethanes of different hardnesses. Describing the hardnesses, expressed as the sinking ratio by the weight of a human head when using the composite pillow, a soft urethane whose sinking ratio is 60% is employed for the head top side central portion 12; a rather hard urethane whose sinking ratio is 40% is employed for the neck side central portion 11; and a hard urethane whose sinking ratio is 20% is employed for the right and left holding parts 22, 23, thereby achieving different hardnesses. This is just one example of a hardness combination, and other combinations are possible as a matter of course.

The contact surfaces 13, 14 of the neck side central portion 11 and the head top side central portion 12 are diagonally formed. Specifically, the contact surface 13 of the neck side central portion 11 contacting the head top side central portion 12 is inclined so as to protrude the lower portion of the head top side central portion 12, and the corresponding contact surface 14 of the head top side central portion 12 is inclined so as to cover the contact surface 13 of the neck side central portion 11.

Furthermore, the contact surfaces 15, 16, 17, 18 of the neck side and head top side central portions 11, 12 with the right and left holding portions 22, 23 are also diagonally formed. As a matter of course, the contact surfaces 19, 20 of the right and left holding parts 22, 23 are also diagonally formed corresponding to the contact surfaces 15, 16, 17, 18. Specifically, the contact surfaces 19, 20 of the right and left holding parts 22, 23 contacting the neck side and head top side central portions 11, 12 are inclined so as to protrude toward the lower portion of the neck side, and the corresponding contact surfaces 15, 16, 17, 18 of the neck side and head top side central portions 11, 12 are inclined so as to cover the contact surfaces 19, 20 of the right and left holding portions 22, 23. In addition, the shape and contact condition of the contact surfaces of the third embodiment are similar to those of the first embodiment.

Figure 16:
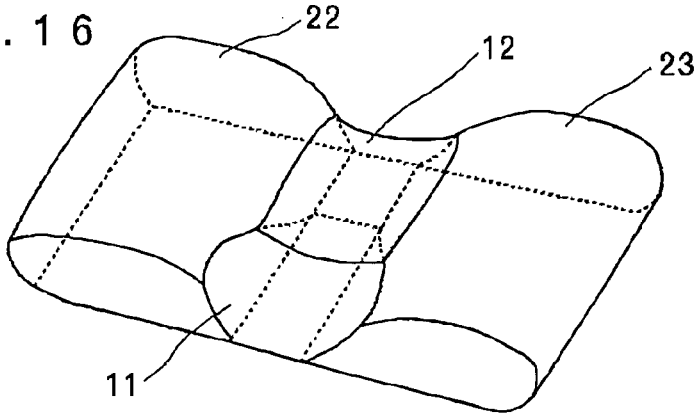
FIG. 16 is a perspective view showing a composite pillow according to a fourth embodiment.
Figure 17:
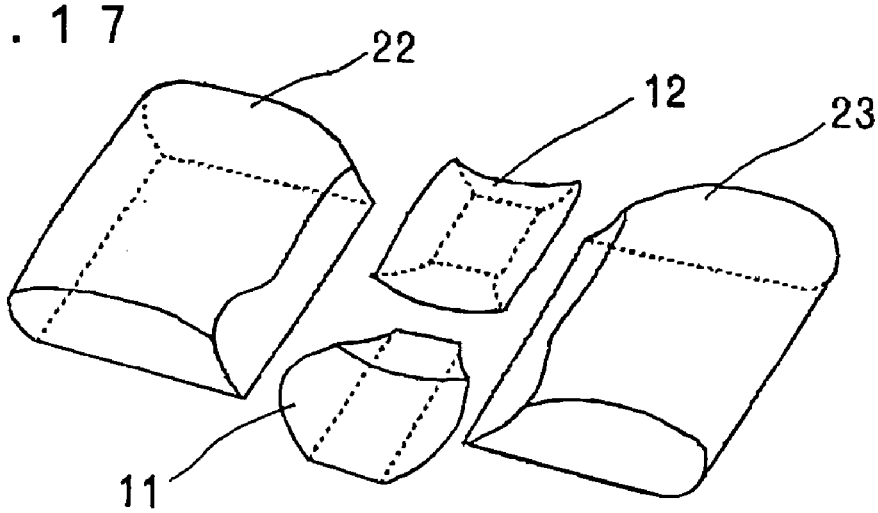
FIG. 17 is an exploded perspective view showing the composite pillow according to the fourth embodiment.

As shown in FIGS. 16 and 17, the composite pillow according to the fourth embodiment has a configuration almost the same configuration as the third embodiment, but the neck side central portion 11 differs from the head top side central portion 12 in height and width. Specifically, as shown in FIG. 16 and FIG. 17, the neck side central portion 11 is formed to be slightly higher and wider right to left than the head top side central portion 12 to enhance cervical vertebrae protection. Due to the difference in shape between the neck side central portion 11 and the head top side central portion 12, the contact surface has an uneven slope shape, not an even slope as in the third embodiment.

Figure 18:
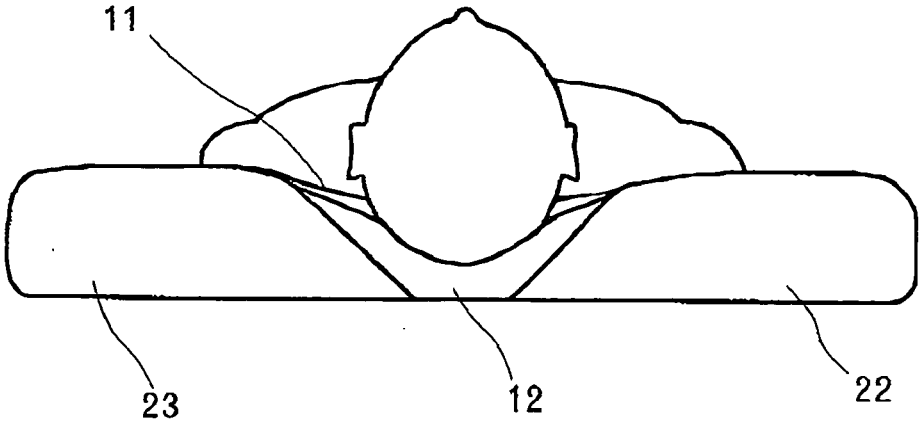
FIG. 18A shows the state of the composite pillow when used lying on the back.
FIG. 18B shows the state of the composite pillow when turning sideways.
FIG. 18C shows the state of the composite pillow when used lying on the side.
Figure 18:
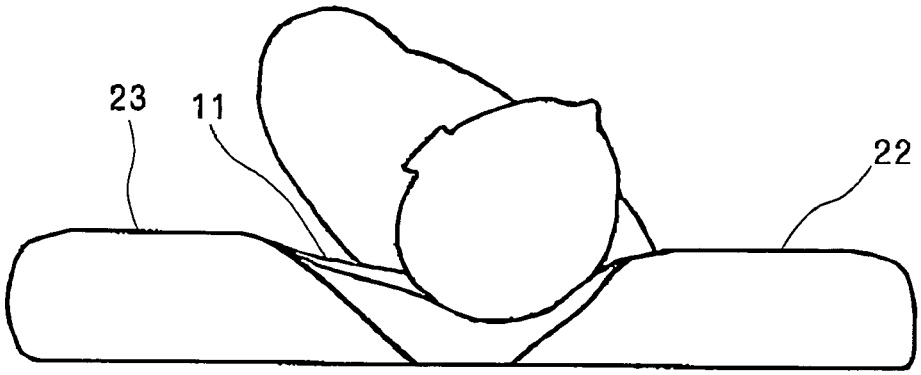
Figure 18:
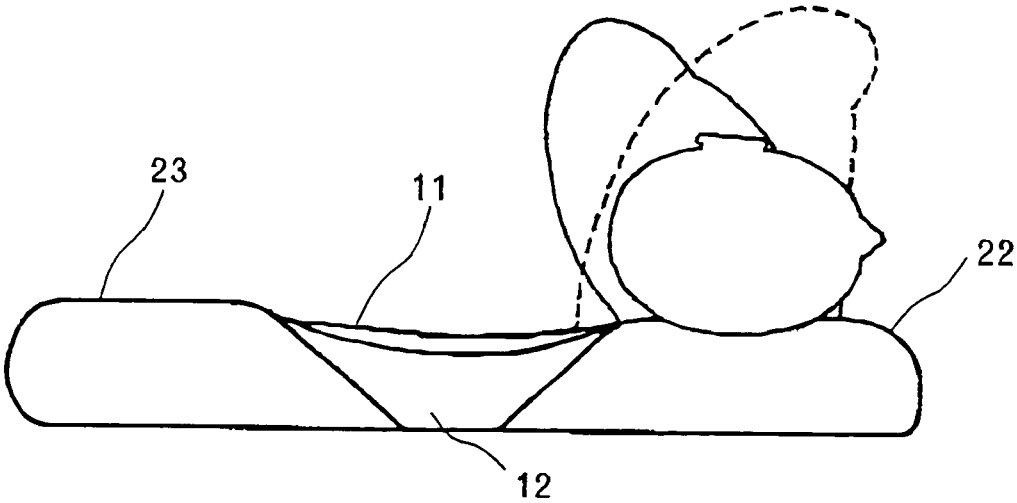
Figure 19:
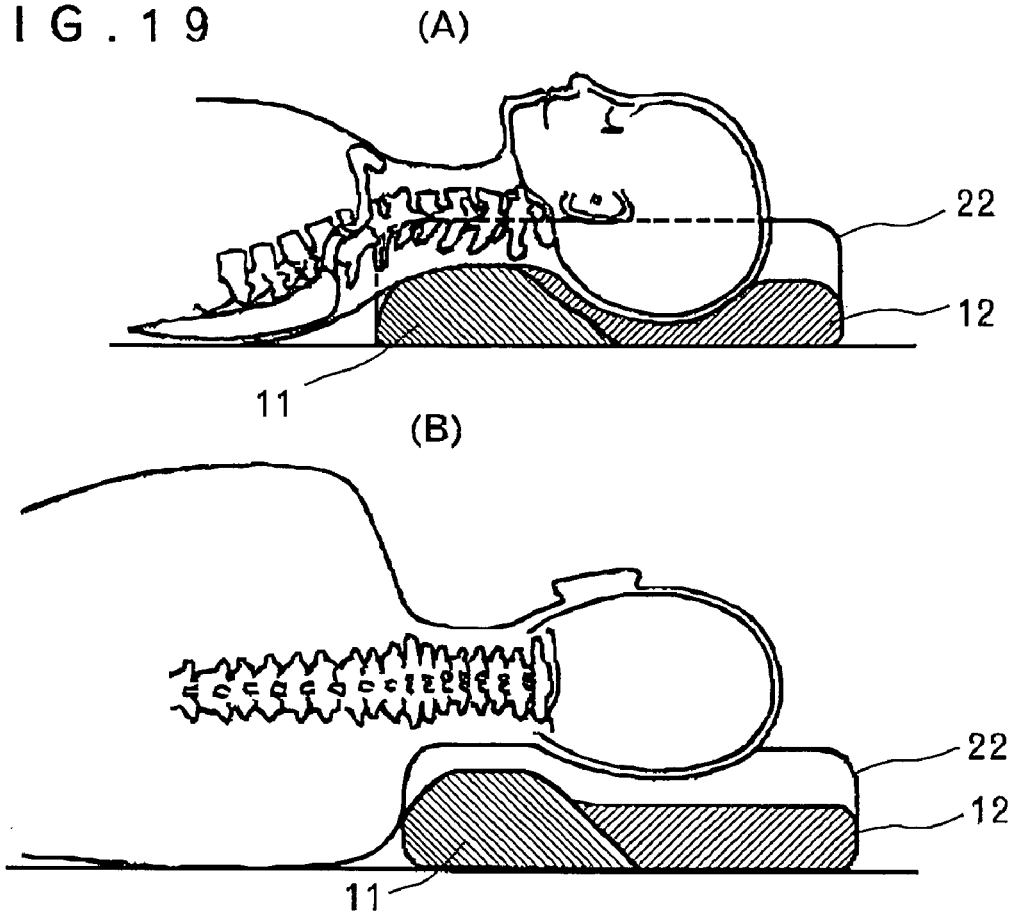
FIG. 19A shows the relation between the composite pillow and the cervical vertebrae when lying on the back.
FIG. 19B shows such a relation when lying on the side.

FIG. 18A and FIG. 19A show use of a pillow of the third or fourth embodiment when lying on the back. If a head is put at the center of the pillow at with the head located on the head top side central portion 12, the neck is located on the neck side central portion 11. In this state, since the neck side central portion 11 is made of a rather hard urethane whose sinking ratio is 40% and the head top side central portion 12 is made of a soft urethane whose sinking ratio is 60%, the neck side central portion 11 supports the neck without sinking deeply, thereby preventing the cervical vertebrae from being damaged by the use of the pillow.

Also, when using the pillow while lying on the side, the position of the head is preferably maintained higher than the case when lying on the back, for cervical vertebrae protection. The composite pillow according to the third and the fourth embodiments, in which the right and left holding parts 22, 23 employ a hard urethane whose sinking ratio is 20%, sinks only slightly due to the weight of the head as shown in FIG. 18C and FIG. 19B, thereby maintaining the head higher than the case when lying on the back. This enables the cervical vertebrae to be maintained straight when using the pillow as shown in FIG. 19B.

When turning sideways from an upward facing position (as a matter of course, vice versa), a head moves from the soft head top side central portion 12 onto the hard right holding part 22 or left holding part, 23 as shown in FIG. 18B. Since the contact surface of both parts 22 and 23 is diagonally formed and protrudes toward the lower portion of the head top side central portion 12, the joint between parts is imperceptible to a user. This is because the hardness gradually increases from the center toward the right and left.

What is claimed is:

1. A composite pillow having a length, a width less than the length and a thickness less than the width, the composite pillow comprising:

a central part (11, 12) having inclined, opposing side surfaces (15, 16, 17, 18) traversing the width and thickness, said central part being divided into separate head (12) and neck (11) portions;

right and left holding parts, (22, 23) each holding part having an inclined surface (19, 20) traversing the width and thickness and extending under and in facing contact with an inclined side surface (15, 16 and 17, 18) of said central part, said central part and said right and left holding parts being arranged in parallel and differing in material or hardness; and wherein said head and neck portions (12, 11) have transverse surfaces (14, 13) which are inclined, with the transverse surface of said neck portion extending under and in facing contact with the transverse surface (14) of said head portion; and wherein said head and neck portions (12, 11) differ in material or hardness.

2. A composite pillow according to claim 1 wherein said head (12) and neck (11) portions are arranged side-by-side, in series along the inclined surfaces (19, 20) of said right and left holding parts (22, 23).

3. A composite pillow according to claim 2 wherein said transverse surfaces (13, 14) are parallel to the length of the composite pillow.

4. A composite pillow according to claim 3 wherein the inclined surfaces (19, 20, 15, 16, 17, 18) and the transverse surfaces (13, 14) are planar.

5. A composite pillow according to claim 4 wherein each of said right and left holding parts (22, 23) and each of said neck and head portions (11, 12) is a separate, monolithic member.

6. A composite pillow according to claim 3 wherein each of said right and left holding parts (22, 23) and each of said neck and head portions (11, 12) is a separate, monolithic member.

7. A composite pillow according to claim 2 wherein the inclined surfaces (19, 20, 15, 16, 17, 18) and the transverse surfaces (13, 14) are planar.

8. A composite pillow according to claim 7 wherein each of said right and left holding parts (22, 23) and each of said neck and head portions (11, 12) is a separate, monolithic member.

9. A composite pillow according to claim 2 wherein each of said right and left holding parts (22, 23) and each of said neck and head portions (11, 12) is a separate, monolithic member.

10. A composite pillow according to claim 1 wherein said transverse surfaces (13, 14) are parallel to the length of the composite pillow.

11. A composite pillow according to claim 10 wherein the inclined surfaces (19, 20, 15, 16, 17, 18) and the transverse surfaces (13, 14) are planar.

12. A composite pillow according to claim 11 wherein each of said right and left holding parts (22, 23) and each of said neck and head portions (11, 12) is a separate, monolithic member.

13. A composite pillow according to claim 10 wherein each of said right and left holding parts (22, 23) and each of said neck and head portions (11, 12) is a separate, monolithic member.

14. A composite pillow according to claim 1 wherein the inclined surfaces (19, 20, 15, 16, 17, 18) and the transverse surfaces (13, 14) are planar.

15. A composite pillow according to claim 14 wherein each of said right and left holding parts (22, 23) and each of said neck and head portions (11, 12) is a separate, monolithic member.

16. A composite pillow according to claim 1 wherein each of said right and left holding parts (22, 23) and each of said neck and head portions (11, 12) is a separate, monolithic member.

* * * * *